United States Patent [19]

Soleri et al.

[11] 4,140,543

[45] Feb. 20, 1979

[54] METHOD AND APPARATUS FOR EMPTYING AND CLEANING VISCOUS PRODUCT FROM A DRUM

[75] Inventors: Richard A. Soleri, Westlake Village; Ronald D. Ungar, Van Nuys, both of Calif.

[73] Assignee: Serv-A-Portion, Inc., Chatsworth, Calif.

[21] Appl. No.: 824,787

[22] Filed: Aug. 15, 1977

[51] Int. Cl.[2] ..... B08B 9/00

[52] U.S. Cl. ..... 134/22 R; 134/23; 134/33; 134/99; 134/135; 134/153

[58] Field of Search ..... 134/18, 22 R, 23, 33, 134/99, 135, 153

[56] References Cited

U.S. PATENT DOCUMENTS 2,763,564 9/1956 McKenzie et al. ..... 134/22 R

FOREIGN PATENT DOCUMENTS 1387445 6/1973 United Kingdom ..... 134/22 R

*Primary Examiner*—Arthur D. Kellogg

*Attorney, Agent, or Firm*—Flehr, Hohbach, Test, Albritton & Herbert

[57] ABSTRACT

A cylindrical drum containing viscous product, tomato paste, is supported on end with its bung hole at the bottom emptying into a receiving vessel. A stationary spray pipe extends upwardly through the bung hole into the drum when supported on the turntable and includes a number of vertically spaced spray nozzles. Pressurized air is directed through the spray pipe to the top of the drum to remove most of the paste out of the drum. Then, water is sprayed under high pressure from the nozzles while the drum is simultaneously rotated on the turntable until the drum is sufficiently clean for reuse.

15 Claims, 4 Drawing Figures

METHOD AND APPARATUS FOR EMPTYING AND CLEANING VISCOUS PRODUCT FROM A DRUM

BACKGROUND OF THE INVENTION

The present invention relates to a method and apparatus for emptying and cleaning a viscous product, specifically tomato paste, from a cylindrical drum.

In the past, tomato paste has been emptied from drums by "head cutting" or removing one end of the drum and then dumping the product from that end. After product removal, the drums could not be reused. In addition, there was a problem of metal contaminants in the tomato paste. Also, head cutting is a labor intensive procedure.

In an approach to overcome some of the foregoing problems a costly system has been introduced by FranRica Manufacturing, Inc. In this system, the drum is rotated upside down and air is injected into the paste from a shaft extending into the bung hole. The manufacturer states that 50% to 90% of the paste is displaced in this manner. Then, warm water is delivered to the drum from three spray nozzles on a rotating assembly at the lower end of the drum. The manufacturer states that to clean a 55-gallon drum of tomato paste requires about 40 to 50 gallons of water.

Prior to emptying of the drum in the FranRica system, the drum head is subjected to a high vacuum and drawn into a convex shape. This is apparently necessary in that system because it is incapable of cleaning a drum with its end flat, presumably because of the difficulties in cleaning the area where the drum end meets the cylindrical side wall.

The FranRica system is subject to a number of major disadvantages. The equipment requires a large capital outlay due to the expensive vacuum system for drawing the drum head to a convex shape and to the cost of an expensive rotating spray head. In addition, a relatively high dilution of the paste with water is employed so that the final product is only suitable for relatively dilute applications and could not be used for more concentrated products such as catsup.

SUMMARY OF THE INVENTION AND OBJECTS

In the present invention, a method and apparatus is provided for emptying and cleaning the viscous product, specifically tomato paste, from a cylindrical drum. The drum is inverted so that the bung hole is downwardly directed and the drum is lowered so that a spray pipe shaft extends upwardly into the drum. Air is supplied to the top of the drum of force most of the paste out of the drum. Then, water is sprayed under high pressure against the interior walls of the drum while the drum is simultaneously rotated on its own axis on a turntable. By appropriate adjustment of the spacing and pressure of the sprays and the speed of rotation, the drum is aseptically cleaned for reuse with a minimum amount of water and without the requirement of applying a vacuum to draw the drum head to a convex shape.

It is an object of the present invention to provide an economical apparatus and method for emptying and cleaning a viscous product, specifically tomato paste, from a cylindrical drum.

It is a particular object of the invention to provide an apparatus of the foregoing type capable of asceptic cleaning without modifying the shape of the drum.

It is another object of the invention to provide an apparatus of the foregoing type which is operable with stationary spray nozzles.

It is another object of the invention to provide such an apparatus capable of emptying a drum with such minimal water requirements that at 100% tomato paste yield, the product is sufficiently concentrated for use as catsup.

Further objects and features of the invention will be apparent from the following description taken in conjunction with the appended drawings.

DETAILED DESCRIPTION OF THE PREFERRED EMBODIMENTS

Although the apparatus and process of the present invention is applicable to the emptying and cleaning of a variety of viscous products from drums, it is particularly applicable to tomato paste. For simplicity, the following description will refer to tomato paste as the product, and water will be referred to as the wash liquid of choice.

Figure 1:
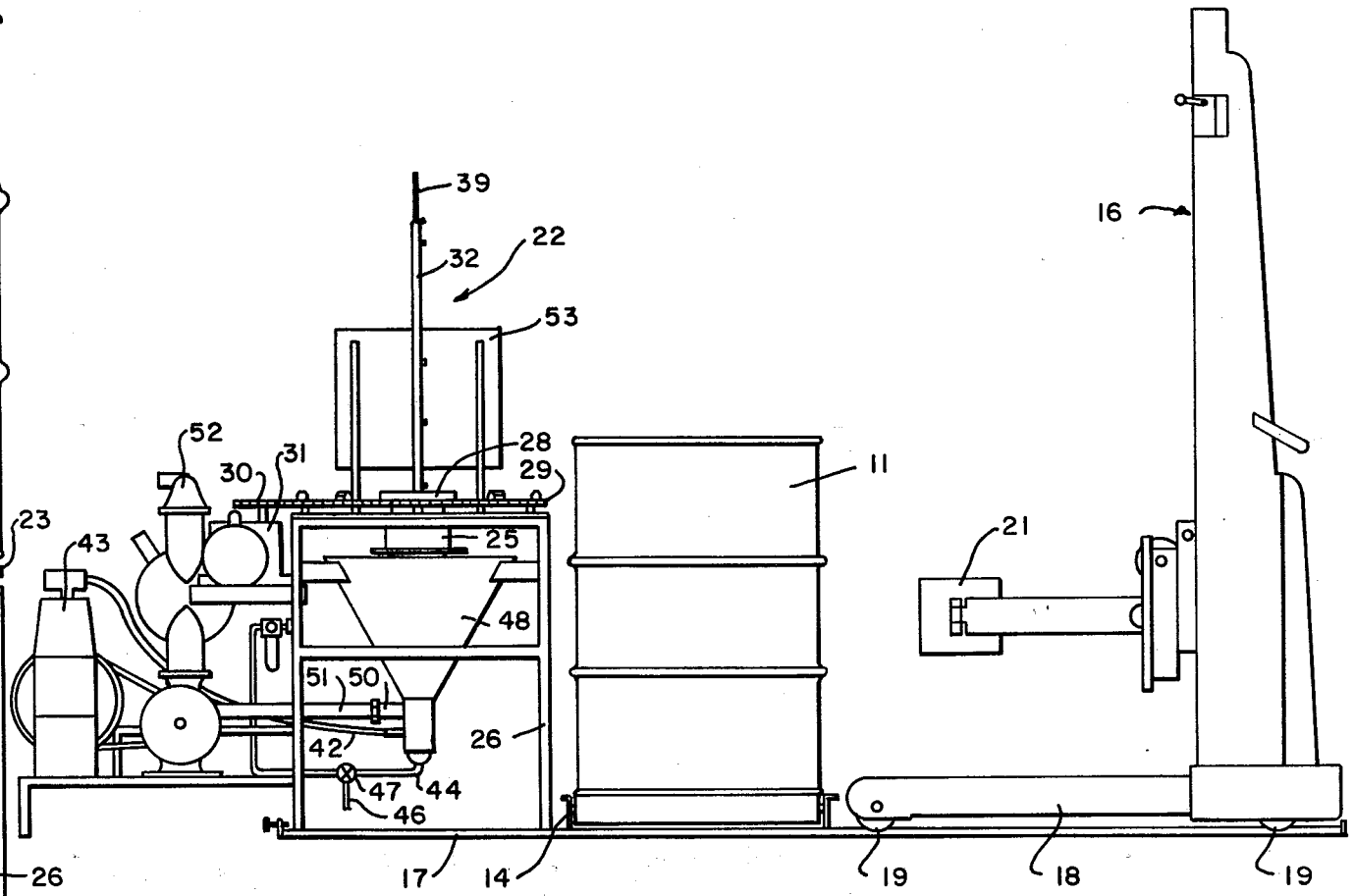
FIG. 1 is a side elevational view of apparatus in accordance with the present invention.
Figures 3, 4:
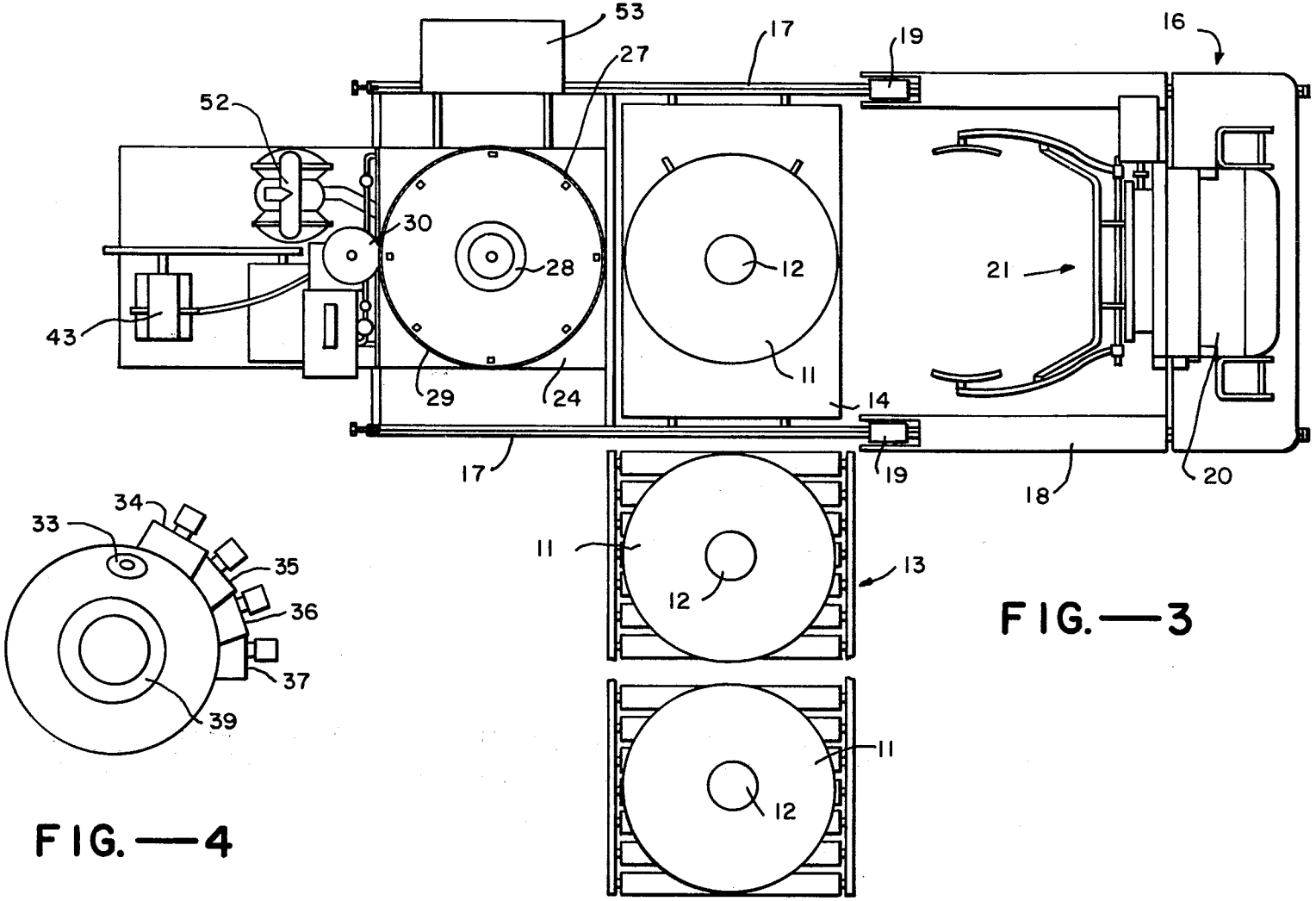
FIG. 3 is a top view of the apparatus of FIG. 1.
FIG. 4 is a top expanded view of the spray pipe of the present invention.

Referring to the system of FIGS. 1 and 3, a number of drums 11 including bung holes 12 are staged on a roller conveyor 13. To start the emptying procedure, the drum is pushed from conveyor 13 onto a pick-up station on positioning platform or plate 14.

An electric lift of the Big Joe type, generally designated 16, is provided to lift drums 11 one at a time from plate 14, invert it, and place it on the turntable in an inverted position as described hereinafter. Lift 16 is mounted on tracks 17 to maintain it in alignment with the pick-up station on platform 14 and the emptying and cleaning station on the turntable. Lift 16 includes a support base 18 mounted on wheels 19 which roll along tracks 17. It also includes an upright column 20 to which is mounted adjustable clamping mechanism 21.

In operation, lift 16 is pushed into contacting position with drum 11 on positioning plate 14 and clamping mechanism 21 is secured to the drum. The drum is inverted and rotated to a height above the spray pipe described below by means of a conventional limit switch. Then, the lift is pushed forward on tracks 17 over the emptying and cleaning station 22 till wheels 19 contact preset stops on tracks 17. Then, the drum is lowered at station 22 as set forth below and clamping mechanism 21 is released.

At emptying and cleaning station 22, a rotatably mounted turntable 23 is supported on elevated platform 24 mounted on upright frame 26. Turntable 23 includes eight circumferentially spaced positioning knobs 27 for contacting the extending lip of drums 11 and precisely aligning the same. A sealing ring 28, suitably formed of Teflon or the like, is mounted to surround product outlet pipe 25 in the center of turntable 23. Ring 28 forms a liquid-tight seal against bung hole 12 of drum 11 when seated on the turntable.

Means is provided for rotating turntable 23 and thereby rotating the drum seated thereon about its own axis. In the illustrated embodiment, such means comprises a continuous chain 29 mounted to the rim of rotatable turntable 23 which is connected via sprocket gear 30 to gear box and drive motor 31 for rotation of the table at the desired speed.

Liquid spray means is provided for emptying and cleaning a drum seated on turntable 23. Such spray means is in the form of an assembly comprising elongate upright spray pipe 32 which extends upwardly through outlet pipe 25 of turntable 27. Five spray nozzles designated from top to bottom 33, 34, 35, 36, and 37 are mounted in vertically spaced positions on spray pipe 32 and communicate to the interior of the same. In addition to being vertically spaced, nozzles 34–37 are also progressively circumferentially spaced from each other at angular increments of about 25°.

An inner or central hollow pipe 39 with an upper outlet is mounted concentrically with spray pipe 32 and extends upwardly from the top thereof. Spray pipe 32 and central pipe 39 define an annular passageway 40 in communication with spray nozzles 33–37. The top of this passageway through which central pipe 39 projects is coupled with a suitable liquid sealing ring against upwardly extending pipe 39.

The lower end of pipes 32 and 39 are joined in coupling 41. A high pressure line 42 for wash liquid (water) is connected at one end to annular passageway 40 and at the other end to a high pressure water pump 43 rated at, say, 500 psi. Central pipe 39 is connected through coupling 41 to a pressurized gas line 44 which is connected at its other end to a suitable air compressor, not shown. In addition, a water line 46 is connected to gas line 44 via valve 47 to supply water from a suitable low pressure source such as a water tap.

A suitable vessel such as inverted conically shaped hopper 48 is provided directly below pipe 25 for receiving a product from the interior of the drum 11. The hopper receives the initial concentrated tomato paste and thereafter a mixture of wash water and tomato paste. The product is removed from hopper through hopper outlet pipe 50 interconnected to product outlet line 51 under suction created by suction pump 52. A suitable pump to remove these viscous liquids is an air operated double diaphragm pump supplied by Wilden Pump & Engineering Co. of Colton, Calif. under the designation "Wilden Pump M8".

All of the operations performed at emptying and cleaning station 22 are actuated by control panel 53 capable of automatic, semi-automatic or manual control.

After removal from hopper 48, the product is directed to one or more mixing and holding tanks (not shown) for the addition of other ingredients to form the desired final product. Thus, for example, if the ultimate product is catsup, spices and the like are added to such mixing and holding tanks.

Figure 2:
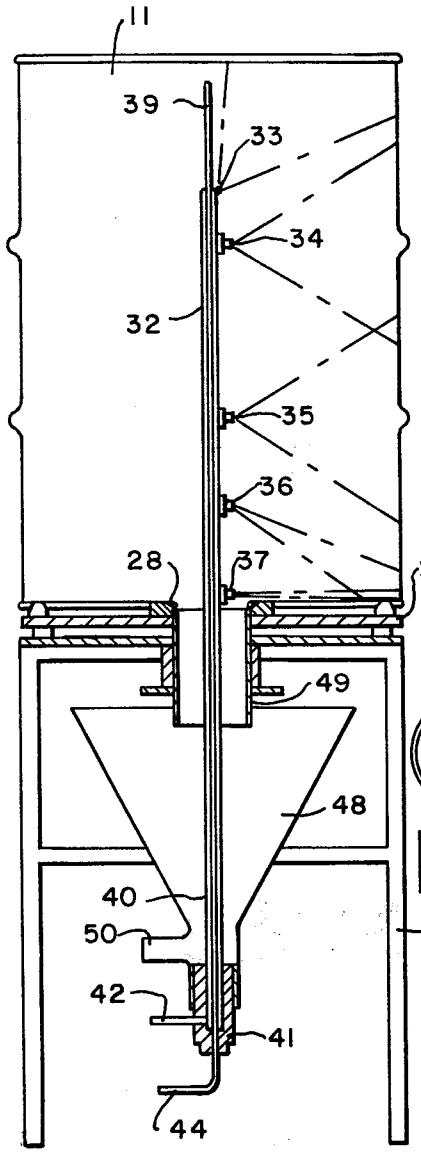
FIG. 2 is a cross-sectional expanded view of a portion of the apparatus of FIG. 1 with a drum in place, illustrating the general spray configuration.

Referring to FIG. 2, a suitable spray pattern for the composite of spray nozzles 33–37 is illustrated with drum 11 in place. Top nozzle 33 is directed upwardly in a cone to the top wall and side wall of drum 11. In the illustrated embodiment, that spray nozzle is disposed at the top of spray pipe 32. Spray nozzle 34 is slightly below nozzle 33 but also in the upper portion of the spray pipe from which water is directed in a cone to impact the cylindrical side wall of drum 11. Nozzle 35 is centrally located and includes a similar conical spray pattern to that of nozzle 34. The spray from nozzles 33 and 34 overlap each other. Nozzle 36 includes a narrower conical spray configuration and thus a spray of greater impact directed to the intersection of the side and bottom walls of drum 11. The spray pattern from nozzle 37 is directed generally parallel to the bottom wall of the drum with a relatively narrow spread of liquid and so creates a high impact at contact. The combination of spray from nozzles 36 and 37 have been found sufficient to clean the bottom periphery of the drum of all remnants of product for the first time without the requirement of deforming the bottom wall of the drum. In a typical operation, pump 43 is rated at 500 psi with water emitting from the nozzles at approximately 350–400 psi.

Operation of the above system can be carried out as follows. A series of full drums are staged on roller conveyor 13 and the bungs are removed from bung holes 12. A drum 11 is then pushed from the conveyor onto positioning plate 14. Then, electric lift 16 is moved forward on tracks 17 and clamping mechanism 21 is extended to clamp and secure the drum. Then, the drum is inverted and rotated to a height above the top of pipe 39 so that bung hole 12 is directly above that pipe and the drum is slowly lowered into position on turntable 23.

In the first step of the actual emptying and cleaning operation, valve 47 is actuated to permit a small volume of water to flow through line 44 and out of the top opening in line 39 to the head space above the tomato paste in drum 11. After sufficient water is provided to form a continuous water layer on the tomato paste product, valve 47 is actuated to close off the water and direct air under pressure from a compressor to the same line. At this point, air under a typical pressure of 15 psi is directed to the top of the product to press against the water layer above the tomato paste. The water layer serves as a liquid piston against which the air drives the product out of the bung hole and into hopper 48. In a typical operation, approximately 70 to 90% of the product is removed at this time in about 1-½ minutes at an air pressure of about 15 psi.

In the next step of the operation, warm water at say 190° F. is pumped, say, at 500 psi from pump 43 through line 42 into annular passageway 40 and is forced out of nozzles 33 through 37, inclusive, in a spray pattern generally illustrated in FIG. 2. Simultaneously with spray from the nozzles, the drum is rotated on turntable 23 by sprocket gear 30, suitably at a speed of about 12 to 14 revolutions per minute in a counter-clockwise direction. In this manner, the interior walls of the drum are repeatedly contacted by a plurality of sprays which impact to loosen and carry away any retained tomato paste on the walls. As illustrated in FIG. 4, nozzles 34–37 are progressively radially spaced with the uppermost one furthest advanced in a clockwise direction or a direction opposite to that of drum rotation. In this manner, the tomato paste loosened to slide downwardly by contact of spray from spray nozzle 34 is repeatedly contacted with the spray from the lower nozzles to assist continuation of the downward movement of paste. This is a particularly effective arrangement of spray nozzles.

In a typical cleaning operation for a 55-gallon drum full of tomato paste, it has been found that the total water content of less than 40 gallons or typically 30 to 40 gallons is sufficient to totally clean the drum for reuse in a typical operating time of 6 minutes. With this relatively low quantity of water, the product removed from the system is at a sufficiently high concentration for use in such concentrated products as catsup or the like.

All product and wash water removed from the drum is received in hopper 48 and drawn by suction created by pump 52 through outlet line 51 for removal to a suitable holding and mixing tank to formulate the desired final product. Thus, the initial concentrated tomato paste is mixed with the remnants of tomato paste mixed with the wash water and other additives to form a final product of uniform consistency.

What is claimed is:

1. Apparatus for emptying and cleaning a viscous product from a cylindrical drum with a centrally disposed bung hole in one end wall of the drum, said apparatus comprising:

(a) means for supporting said drum on end with said bung hole directed downwardly, (b) means for receiving viscous product from said bung hole, (c) gas supply means for directing a gas stream through an outlet, said outlet being in a position to be in the upper portion of said supported drum to urge most of the viscous product out of said drum through said bung hole into said product receiving means, (d) liquid spray means including an upright elongate spray pipe adapted to extend through said bung hole on an axis generally parallel to the cylinder wall of said supported drum, said spray means including a plurality of vertically spaced spray nozzles on said pipe for spraying liquid generally in conical configuration, said gas outlet being above said liquid spray nozzles, and (e) means for rotating said supported drum on an axis generally about said spray pipe while liquid is directed from said nozzles toward said drum interior walls for washing.

2. The apparatus of claim 1 in which said drum supporting means comprises a rotatable turntable, and said rotating means comprises a motor for rotating said turntable.

3. The apparatus of claim 1 in which said spray pipe is nonrotatably mounted.

4. Apparatus for emptying and cleaning a viscous product from a cylindrical drum with a centrally disposed bung hole in one end wall of the drum, said apparatus comprising:

(a) means for supporting said drum on end with said bung hole directed downwardly, (b) means for receiving viscous product from said bung hole, (c) gas supply means for directing a gas stream through an outlet adjacent the top of said supported drum to urge most of the viscous product out of said drum through said bung hole into said product receiving means, (d) liquid spray means including an upright elongate spray pipe adapted to extend through said bung hole on an axis generally parallel to the cylinder wall of said supported drum, said spray means including a plurality of vertically spaced spray nozzles on said pipe for spraying liquid generally in conical configuration, (e) means for rotating said supported drum on an axis generally about said spray pipe while liquid is directed from said nozzles toward said drum interior walls for washing, and (f) an inner pipe concentrically mounted within said spray pipe defining an annular passageway therebetween, said liquid spray nozzles communicating with said annular passageway, and said gas supply means communicating with the interior of said inner pipe.

5. The apparatus of claim 4 together with means for intermittently supplying water to said inner pipe.

6. The apparatus of claim 1 in which at least one of said plurality of nozzles is disposed toward the top of said spray pipe while at least another one of said nozzles is disposed toward the bottom of said spray pipe.

7. The apparatus of claim 6 in which said other nozzle is directed radially outward from said spray pipe generally parallel to the lower wall of the supported drum.

8. The apparatus of claim 1 in which said nozzles are progressively circumferentially spaced from each other.

9. In a method for emptying and cleaning a viscous product from a cylindrical drum with a centrally disposed bung hole in one end wall of the drum, the steps of (a) supporting said drum on end filled with viscous product and with said bung hole open and directed downwardly, (b) directing a gas to the top of said supported drum to urge viscous product out of said bung hole into a product receiving vessel to thereby empty most of the product from the drum, and (c) directing wash liquid under high pressure from a plurality of vertically spaced nozzles in generally conical sprays to impact against the interior walls of said mostly empty drum and loosen and carry away product retained thereon, and simultaneously rotating said drum about its axis to remove essentially all product from the interior of said drum.

10. The method of claim 9 in which said nozzles are stationary during spraying.

11. The method of claim 9 in which prior to step (b) a volume of wash liquid sufficient to form a continuous liquid layer is directed to the top of said drum to serve as a liquid piston against which said gas is directed to empty the drum.

12. The method of claim 9 in which said at least one of said vertically spaced spray nozzles is disposed in the upper half of said drum during step (c).

13. The method of claim 9 in which said viscous product is tomato paste and said wash liquid is water.

14. The method of claim 9 in which at least one nozzle directs a spray generally parallel to the bottom wall of the drum.

15. The method of claim 9 in which said nozzles are progressively radially spaced with the uppermost one the furthest advanced opposite the direction of drum rotation so that viscous product loosened to slide downwardly by contact of spray from the uppermost nozzle is again contacted with the spray from at least one lower nozzle to assist continuation of its downward movement.

* * * * *